US011081297B2

(12) United States Patent
Guillard

(10) Patent No.: US 11,081,297 B2
(45) Date of Patent: Aug. 3, 2021

(54) HYBRIDIZATION SYSTEM FOR HIGH VOLTAGE DIRECT CURRENT

(71) Applicant: LEACH INTERNATIONAL EUROPE, Sarralbe (FR)

(72) Inventor: Eric Guillard, Gratentour (FR)

(73) Assignee: LEACH INTERNATIONAL EUROPE S.A.S., Sarralbe (FR)

( * ) Notice: Subject to any disclaimer, the term of this patent is extended or adjusted under 35 U.S.C. 154(b) by 425 days.

(21) Appl. No.: 15/992,311

(22) Filed: May 30, 2018

(65) Prior Publication Data

US 2018/0350533 A1 Dec. 6, 2018

(30) Foreign Application Priority Data

May 30, 2017 (FR) ..... 1754754

(51) Int. Cl.
*H01H 1/20* (2006.01)
*H01H 9/38* (2006.01)
*H01H 9/54* (2006.01)

(52) U.S. Cl.
CPC ..... *H01H 9/542* (2013.01); *H01H 1/20* (2013.01); *H01H 9/38* (2013.01); *H01H 9/547* (2013.01);
(Continued)

(58) Field of Classification Search
CPC ..... H01H 1/20; H01H 9/38; H01H 9/383; H01H 9/386; H01H 9/50; H01H 9/54;
(Continued)

(56) References Cited

U.S. PATENT DOCUMENTS

2012/0007657 A1* 1/2012 Naumann ..... H01H 9/542 327/434
2012/0133693 A1* 5/2012 Iijima ..... B41J 2/04581 347/10

(Continued)

FOREIGN PATENT DOCUMENTS

DE 202009004198 U1 8/2010

OTHER PUBLICATIONS

Search Report and Opinion for French Patent App. No. 1754754 (dated Feb. 12, 2018).

*Primary Examiner* — Nguyen Tran
*Assistant Examiner* — Ivan Laboy
(74) *Attorney, Agent, or Firm* — Kenealy Vaidya LLP

(57) ABSTRACT

A hybridization system for an electric device having two terminals and two states including a closed state allowing an electric current to circulate between the two terminals and an open state blocking the circulation of the electric current between the terminals, the device being suitable for an electric arc to be generated during the switching from the closed state to the open state. The hybridization system includes: two conductors connected to the two terminals of the electric device; a timer switch having two terminals connected to the two conductors and the timer switch being suitable for being in the open state by default and, after a first predetermined duration following the triggering of the electric arc, switching to the closed state for a second predetermined duration, and an electric power supply of the timer switch, connected to the two conductors in order to derive its power only from the electric energy provided by the electric arc.

7 Claims, 6 Drawing Sheets

(52) U.S. Cl.
CPC ..... *H01H 9/548* (2013.01); *H01H 2009/543* (2013.01); *H01H 2009/544* (2013.01); *H01H 2009/546* (2013.01)

(58) Field of Classification Search
CPC ..... H01H 9/541; H01H 9/542; H01H 9/547; H01H 9/548; H01H 9/302; H01H 9/32; H01H 9/34; H01H 9/342; H01H 9/345; H01H 9/346; H01H 9/36; H01H 9/362; H01H 9/40; H01H 9/42; H01H 9/44; H01H 9/443; H01H 9/446; H01H 9/46; H01H 9/465; H01H 2009/305; H01H 2009/307; H01H 2009/343; H01H 2009/347; H01H 2009/348; H01H 2009/365; H01H 2009/367; H01H 2009/544; H01H 2009/546; H01H 73/18; H01H 2083/201; H02H 1/00; H02H 1/0007; H02H 1/0015; H02H 7/26
See application file for complete search history.

(56) References Cited

U.S. PATENT DOCUMENTS

| | | | | |
|---|---|---|---|---|
| 2013/0147392 | A1* | 6/2013 | Lai | H05B 45/37 315/297 |
| 2014/0091059 | A1* | 4/2014 | Henke | H01H 9/54 218/8 |
| 2014/0091061 | A1* | 4/2014 | Henke | H01H 9/542 218/8 |
| 2014/0175060 | A1 | 6/2014 | Reymond et al. | |
| 2018/0122612 | A1* | 5/2018 | Koepf | H02H 7/1222 |
| 2019/0279830 | A1* | 9/2019 | Omori | H01H 9/542 |
| 2019/0287742 | A1* | 9/2019 | Omori | H01H 9/547 |
| 2019/0348245 | A1* | 11/2019 | Henricks | H01H 85/0241 |

* cited by examiner

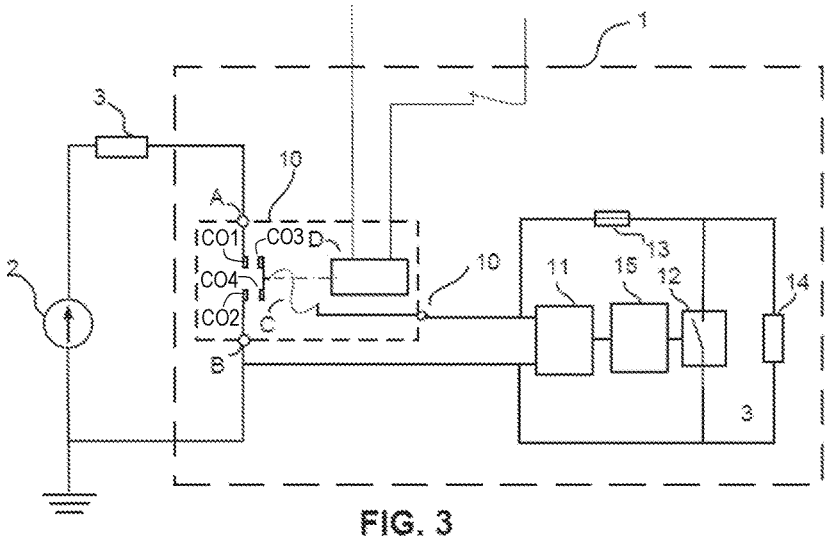

1 - hybrid contactor
2 - power source
3 - load
10 - electromechanical contactor
11 - electronic power supply
12 - electronic switch
13 - second protection circuit
14 - first protection circuit
15 - control circuit
D - electromagnet CO1 - fixed contact
CO2 - fixed contact
CO3 - movable contact
CO4 - movable contact

FIG. 3

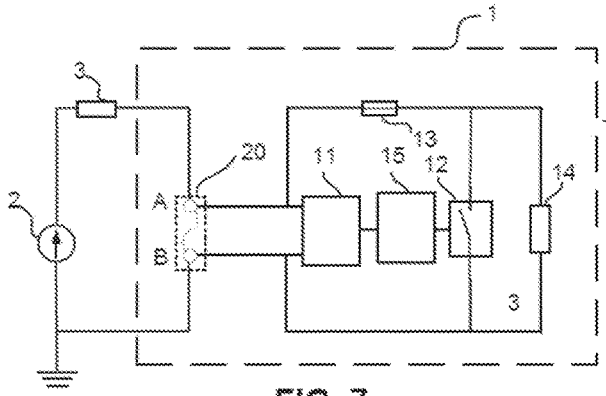

1 - hybrid contactor
2 - power source
3 - load
11 - electronic power supply
12 - electronic switch
13 - second protection circuit
14 - first protection circuit
15 - control circuit
20 - fuse

FIG. 7

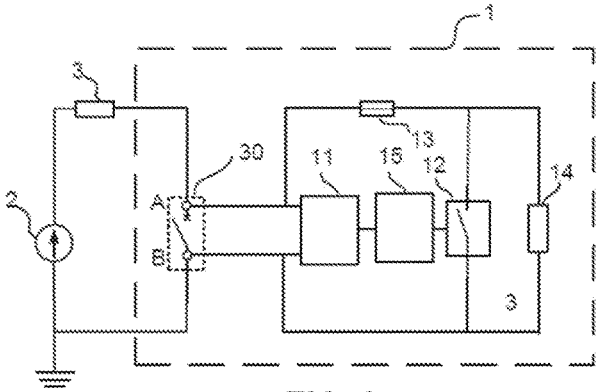

1 - hybrid contactor
2 - power source
3 - load
11 - electronic power supply
12 - electronic switch
13 - second protection circuit
14 - first protection circuit
15 - control circuit
30 - circuit breaker

FIG. 9

HYBRIDIZATION SYSTEM FOR HIGH VOLTAGE DIRECT CURRENT

CROSS REFERENCE TO RELATED APPLICATION(S)

This application claims the priority benefit under 35 U.S.C. § 119 of French Patent Application No. 1754754, filed on May 30, 2017, the content of which is hereby incorporated in its entirety by reference.

BACKGROUND

Some embodiments relate to an electronic hybridization system suitable for making a contactor, a fuse or a circuit breaker operate at high voltage under direct current. Some embodiments have applications in the field of electric power distribution, and more particularly in the field of on-board electric power distribution.

Hybrid contactors are contactors that use two simultaneous switching technologies, one based on electromechanical switching and the other based on electronic switching using semiconductors. Each of these technologies has advantages and disadvantages.

Electromechanical switching provides a low voltage drop at the terminals of the contactor and good galvanic insulation. However, electric arcs are created during opening and the closing of the contactor leading to an erosion of the contacts. Electronic switching, however, is free of electric arcs, but does not provide the advantages of the electromechanical technology in terms of voltage drop and galvanic insulation.

The combination of these two technologies, called hybridization, allows the service life of the contacts of the electromechanical contactor and optionally the response time of the contactor upon opening and the closing to be improved.

In the related art, hybridization involves using one or more power transistors in parallel or in series with the electromechanical contactor. The power transistor is thus controlled to assist the electromechanical contactor during opening and closing and eliminate the electric arcs. The energy used for this control is provided from an external auxiliary source.

Such a hybrid contactor is for example described in the patent application US2014/0175060 (Reymond et al.).

Another form of cutout for high-voltage direct current includes or consists of fuses.

Direct-current high-voltage fuses use the electric-arc voltage in order to cut off the current of the circuit in the case of a fault, the disadvantage of these fuses is that they are bulky since the arc voltage is obtained by a greater distance of fusible material that imposes rather long fuse shapes.

Finally, a third type of cutout includes or consists of direct-current high-voltage circuit breakers.

Direct-current high-voltage circuit breakers are generally made via circuits having transistors with a measurement of current and a circuit-breaker logic when the overload limit is exceeded.

Regardless of the type of cutout, it may be necessary to control at best the electric arc generated during a cutoff. And therefore, like for the contactor, it appears to be desirable to use hybridization techniques that combine electromechanical switching and electronic switching in order to enjoy the advantages of each type of switching.

However, hybridization also involves a certain number of disadvantages. The first of these is the complexification of the switching systems. The second disadvantage is the necessity of having an auxiliary power source specific to the electronic portion. This reduces the reliability and increases the maintenance costs since the load of the auxiliary power source must or should be regularly verified.

In the context of a direct-current power supply via a photovoltaic panel, the document US2012/0007657 describes a system for hybrid switching, the electronic portion of which is powered by a capacitor that is charged during the time of formation of the arc created upon opening of the mechanical switch.

SUMMARY

However, the electronic system described is relatively complex and adapted specifically to the environment of photovoltaic panels.

It may therefore be advantageous to provide a hybridization system that addresses or overcomes these defects, disadvantages and obstacles of the related art, in particular of a versatile hybridization system suitable for numerous uses, in particular that is independent of the direction of the direct current.

In order to address or overcome one or more of the disadvantages mentioned above, a hybridization system for an electric device, the electric device having two terminals and two states, a closed state allowing an electric current to flow between the two terminals and an open state blocking the flow of the electric current between the terminals, the device being suitable for an electric arc to be generated during the switching from the closed state to the open state. The system includes:

- two conductors suitable for being connected to the two terminals of the electric device;
- a timer switch having two terminals connected to the two conductors and the timer switch being suitable for being in the open state by default and, after a first predetermined duration d1 following the triggering of the electric arc, switching to the closed mode for a second predetermined duration d2.

The hybridization system further includes an electric power supply of the timer switch, the electric power supply being connected to the two conductors and being suitable to derive its power only from the electric energy provided by the electric arc, the power supply including a rectifier module connected at the input to the two conductors and having an output connected to a ballast, itself connected via a diode to an energy accumulator having two terminals connected to the timer switch.

This eliminates, in a particularly advantageous manner, the need to have an auxiliary power supply to power the electronic switch.

The following are features or specific embodiments, usable alone or in combination:

- the timer switch includes a semiconductor electronic switch connected to the two terminals of the timer switch, and a circuit for controlling the semiconductor electronic switch powered by the electric power supply;
- the system further includes a dissipative circuit connected in parallel to the terminals of the timer switch; and/or
- the system further includes a monitoring circuit powered by the electric power supply and suitable for detecting the electric-arc voltage at the terminals and the electric-arc voltage duration and for generating a signal of correct operation or of anomaly intended for outside monitoring.

In a second aspect of some embodiments, a hybrid contactor suitable for operating under high-voltage direct current includes:

an electromechanical contactor module connected between a first terminal and a second terminal, the electromechanical contactor module including at least two fixed contacts and at least two movable contacts, each of the two movable contacts being suitable for coming into contact with a specific fixed contact between the first terminal and an intermediate terminal distinct from the first and second terminal, the electromechanical contactor module is suitable for selectively being in a closed state or an open state. It further includes a hybridization system according to one of the above embodiments connected between the second terminal and the intermediate terminal.

In a third aspect of some embodiments, a system for electric protection suitable for operating under high-voltage direct current includes a conductive element connected between a first terminal and a second terminal, the conductive element being suitable for switching from a closed state to an open state when the intensity of the current passing through the conductive element exceeds a predetermined value. It further includes a hybridization system according to one of the above embodiments connected between the first terminal and the second terminal.

In a specific embodiment, the conductive element of the protection circuit is a fuse.

In a fourth aspect of some embodiments, a circuit breaker suitable for operating under high-voltage direct current includes a conductive circuit connected between a first terminal and a second terminal, the conductive circuit being suitable for switching from a closed state to an open state when the intensity of the current passing through the conductive circuit exceeds a predetermined overload limit. It further includes a hybridization system according to one of the above embodiments connected between the first terminal and the second terminal.

BRIEF DESCRIPTION OF THE FIGURES

Some embodiments will be better understood upon reading the following description, provided only as an example and in reference to the appended drawings in which:

FIG. 3 shows another embodiment of a hybrid contactor;

FIG. 7 shows a fuse associated with a hybridization system according to an embodiment;

FIG. 9 shows a circuit breaker associated with a hybridization system according to an embodiment.

DETAILED DESCRIPTION OF EXEMPLARY EMBODIMENTS

To clarify the embodiments and the operation of the hybridization system, a hybrid contactor is used as the main example. Then is described the use of the hybridization system for a fuse and for a circuit breaker.

High-voltage direct current means a direct electric current having a voltage greater than 100V.

Thus, the norm is for example 270V for onboard systems in aviation.

Figure 1:
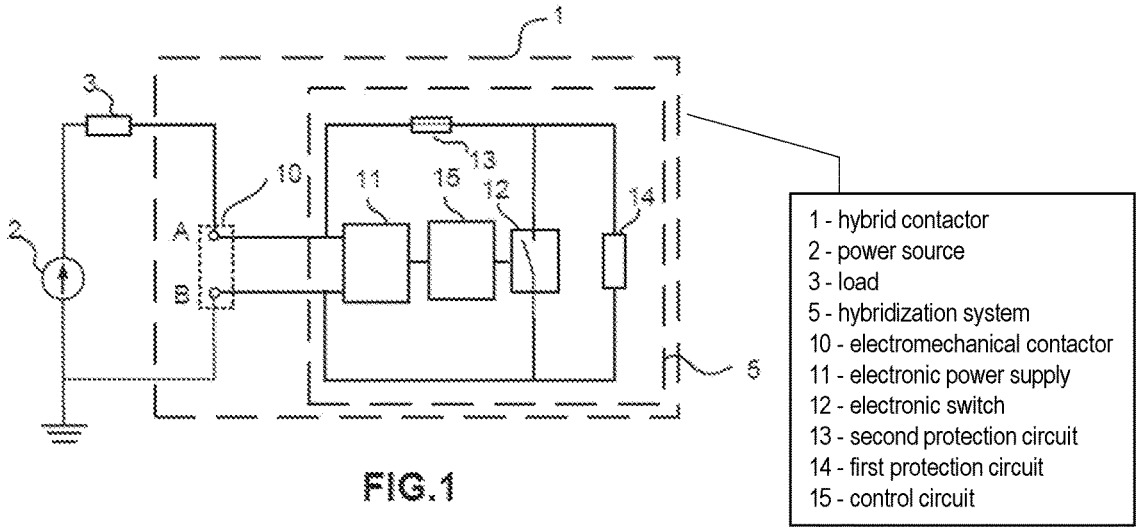
FIG. 1 shows the diagram of a hybrid contactor according to an embodiment.

FIG. 1 illustrates a first embodiment of a hybrid contactor according to a first embodiment. The hybrid contactor, labelled 1, is mounted in series with a direct-current high-voltage electric power source 2 and a load 3.

The hybrid contactor 1 includes an electromechanical contactor 10. This electromechanical contactor is connected between two terminals labelled A and B. The terminal B is connected to the ground. The electromechanical contactor 10 can have two states:

a closed state in which the terminals A and B are electrically connected; and an open state in which the terminals A and B are insulated from each other.

The hybrid contactor 1 further includes a hybridization system 5 including an electronic switch 12 connected between the terminal A of the electromechanical contactor and the terminal B. The electronic switch 12 is controlled by a control circuit 15 powered by an electronic power supply 11.

This electronic power supply is connected directly to the terminals A and B of the electromechanical contactor in such a way as to receive the electric-arc voltage and store this energy.

The hybridization system 5 further includes a first protection circuit 14, of the dissipative type, for protecting the electronic switch 12 against overvoltages when the timer switch is opened. This first protection circuit is mounted in parallel with the electronic switch 12. This first protection circuit 14 is for example a diode for suppressing transient voltage.

The hybridization system 5 further includes a second protection circuit 13 connected in series with the electronic switch 12 between the terminal A and the terminal B, allowing the hybrid contactor to be opened in case of a fault in the electronic switch 12 when the latter remains locked in the closed state. When the electromechanical contactor 10 switches into the open state and the electronic switch 12 remains locked in the closed state, the protection circuit 13 opens and remains open. The protection circuit 13 is for example a fuse.

Figure 2:
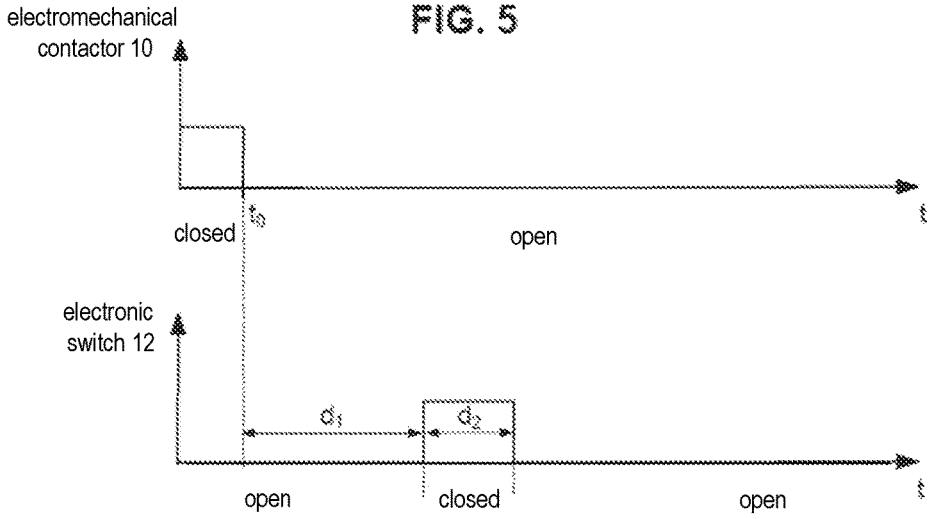
FIG. 2 shows a temporal diagram of the state of the electromechanical contactor and of the electronic switch of the hybrid contactor of FIG. 1.

The control of the electronic switch 12 is illustrated by the temporal diagram of FIG. 2. The control of the electronic switch is arranged according to that of the electromechanical contactor 10 also illustrated by a temporal diagram in FIG. 2. When the electromechanical contactor 10 switches from the closed state to the open state at a time labelled t0, the electronic switch 12 is controlled in order to, after a predetermined duration d1 after the time t0, electrically connect the terminal A to the terminal B for a predetermined duration d2. The electronic switch is in a closed state for the duration d2. It reverts to the open state after the duration d2.

This hybrid contactor allows the presence of electric arcs at the level between the contacts A and B of the electromechanical contactor 10 to be authorized for a limited duration in order to preserve their function of cleaning the contacts without deteriorating the latter.

In a specific example, FIG. 3, the hybrid contactor 1 includes an electromechanical contactor 10 having a movable blade with insulation compatible with a high voltage. This electromechanical contactor, also called twin bridge contactor, is connected between the two terminals labelled A and B. The terminal B is connected to the ground. The electromechanical contactor 10 includes two fixes contacts CO1 and CO2, and two movable contacts CO3 and CO4 mounted on the movable blade C3 made of a conductive material. The movable contacts CO3 and CO4 are permanently connected to each other via the movable blade. The electromechanical contactor 10 can have two states:

- a closed state in which the movable contacts CO3 and CO4 of the movable blade are in contact with the fixed contacts CO1 and CO2, respectively, in such a way as to electrically connect the two fixed contacts CO1 and CO2 to each other; and
- an open state in which the movable contacts CO3 and CO4 of the movable blade are at a distance from the fixed contacts CO1 and CO2.

The control of the movable blade is carried out by an electromagnet D.

In FIG. 3, the hybridization system 4 has a first connector connected to the movable blade in order to establish a voltage transfer and a second connector connected to one of the fixed contacts CO1 and CO2 to illustrate a connection alternative having galvanic insulation without the addition of an additional contact in series.

FIGS. 4A to 4D show the presence or absence of an electric arc at the contacts of the electromechanical contact 10.

Before the time t0 (FIG. 4A), the electromechanical contactor 10 is in the closed state (conductive state) and the movable contacts CO3 and CO4 are in contact with the fixed contacts C01 and CO2, respectively. The electronic switch 12 is in the open state (non-conductive state).

At the time t0, the electromechanical contactor 10 is opened (passage from the closed state to the open state). Electric arcs thus appear between the contact CO1 and the contact CO3 and between the contact CO2 and the contact CO4. These electric arcs are visible in FIG. 4B.

Figure 4A:
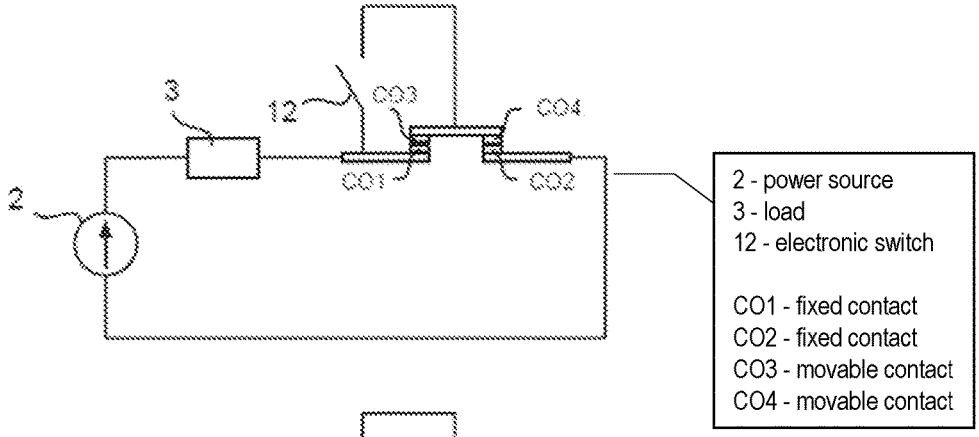
FIG. 4 shows the various phases of operation of the hybrid contactor of FIG. 3.
Figure 4B:
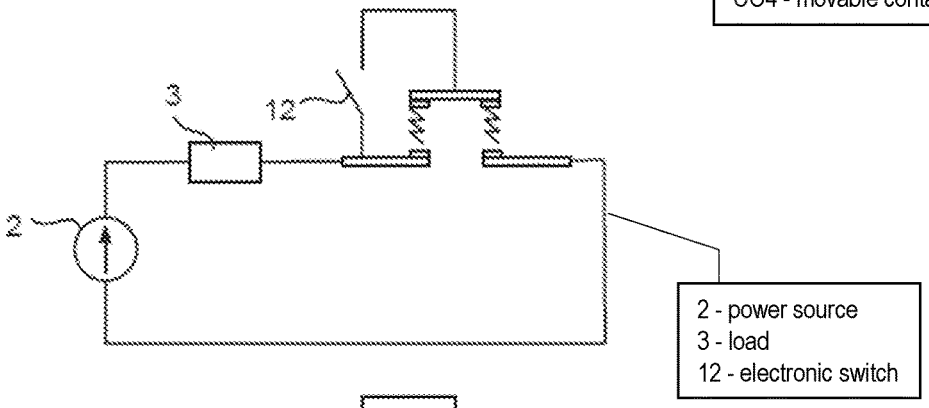
Figure 4C:
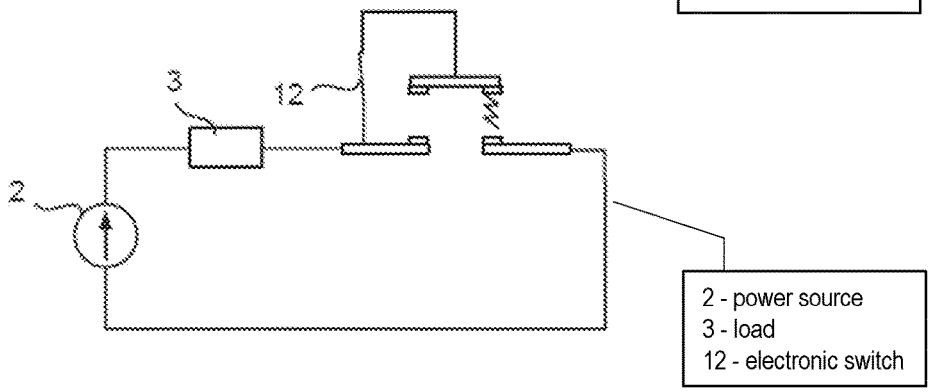

After a duration d1 between 1 μs and 10 ms, the electronic switch 12 switches into the closed state (conductive state). The movable contact CO4 and the fixed contact CO2 are then shunted by the electronic switch 12. The electric arc between the fixed contact CO1 and the movable contact CO3 is thus extinguished as illustrated in FIG. 4C.

The electronic switch 12 is maintained in the closed state (conductive state) for a duration d2 between 1 μs and 10 ms. Since the movable contact CO3 is no longer powered by the electric arc between the fixed contact CO1 and the movable contact CO3.

Figure 4D:
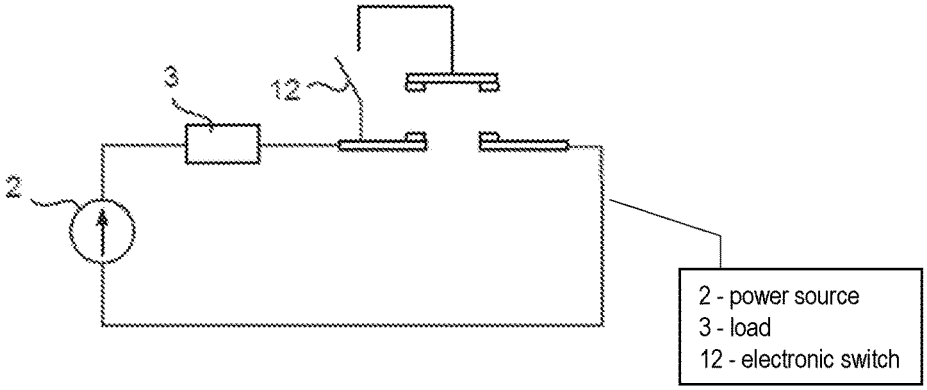

The electronic switch 12 then opens after the duration d2. The electric arc between the movable contact C04 and the fixed contact C04 is extinguished automatically. This passage into the open state is illustrated by FIG. 4D.

This control of the electronic switch 12 allows electric arcs to be authorized in the electromechanical contactor 10 for the duration d1 and then cut off, one after the other, during the duration d2.

Figure 5:
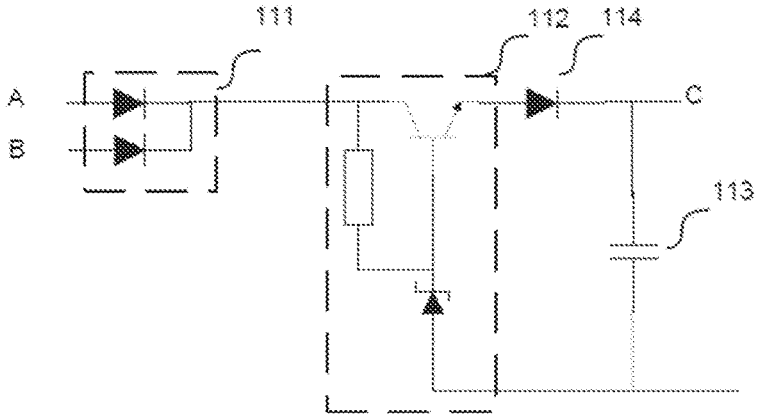
FIG. 5 shows an autonomous power supply according to an embodiment.

The autonomous electronic power supply 11 will now be described in more detail in reference to FIG. 5.

The autonomous electric power supply is thus connected to the terminals A and B of the electromechanical contactor 10. This connection is for example carried out by flexible conductors having a very small cross-section with respect to the cross-section of the conductors of the main circuit.

A rectifier module 111 is directly connected to the connectors of the terminals A and B. It includes or consists of diodes allowing the current flowing through the terminals A and B to be rectified and thus the dependency on the direction of the current between the terminals A and B to be eliminated.

The output of the rectifier module 111 is connected to a ballast 112, the goal of which is to stabilize the power supply.

The output of the ballast 112 is connected to a capacitor 113 that carries out the storage of the energy.

A diode 114 located between the ballast 112 and the capacitor 113 prevents the discharging of the capacitor via the ballast 112.

The capacitor 113 is thus connected to the sequencing logic 15 in order to power the latter, in such a way that the logic is able to control the electronic switch 12.

Thus, the control circuit 15 may not require an external power supply device. It is powered by the energy coming from the electric arcs present when opening the electromechanical contactor 10.

In reference to the timing diagram of FIG. 2, the autonomous electric power supply 11 is not powered as long as the electromechanical contactor 10 is in the closed position since the terminals A and B have practically the same potential.

During the duration $d_1$, the electromechanical contactor 10 is open and an electric arc is established by the difference in potential existing between the terminals A and B. This electric-arc energy is thus used to charge the capacitor 113 during the first moments of $d_1$. The control circuit 15 is thus powered and can close the electronic switch 12 at the end of d1 and for the period $d_2$.

Figure 6:
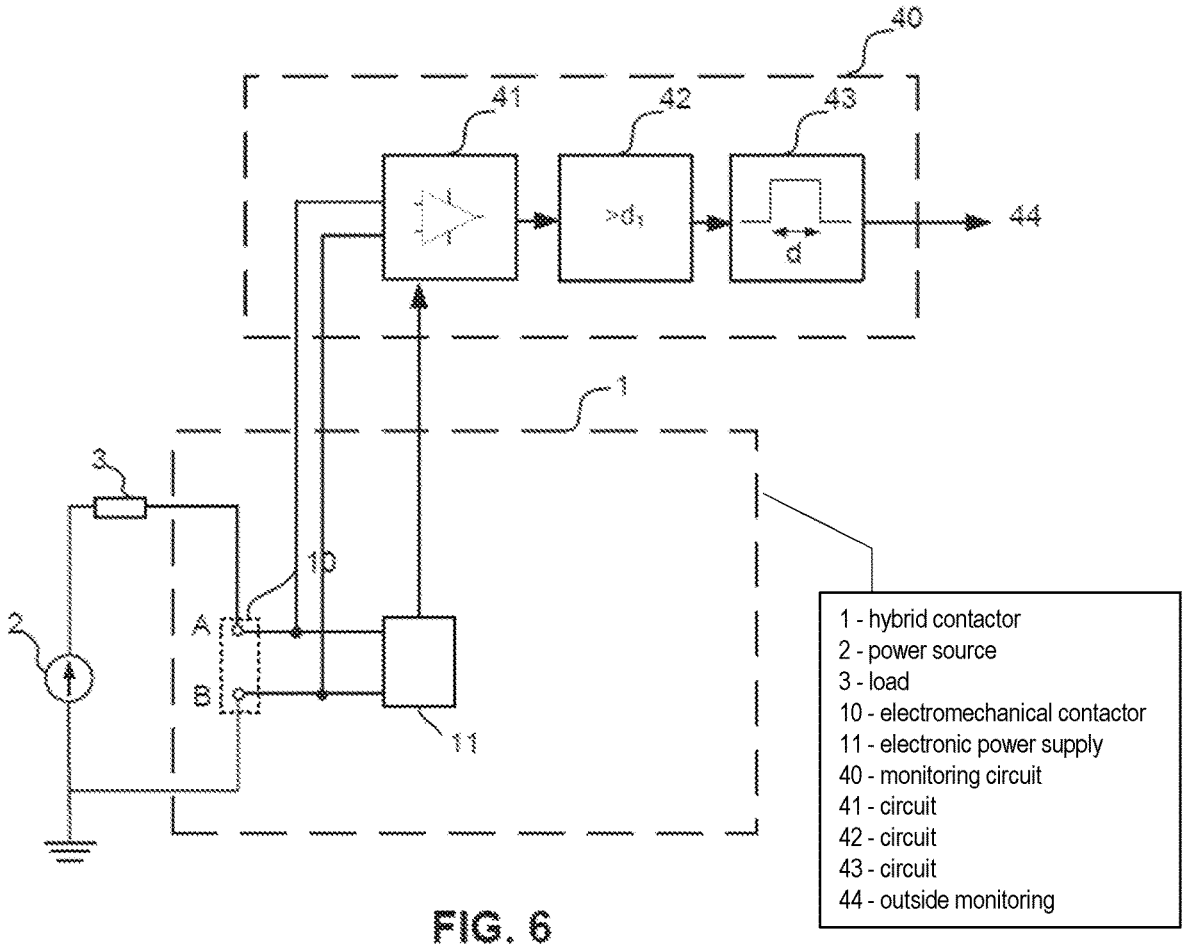
FIG. 6 shows a hybridization system including a monitoring device according to another embodiment.

In a specific embodiment, FIG. 6, the hybridization module 5 further includes a monitoring circuit 40 intended to transmit, to an outside system, a calibrated pulse of good health.

The monitoring circuit 40 is powered by the electric power supply 11 and detects the electric-arc voltage at the terminals A and B via the circuit 41. The circuit 42 detects the arc voltage duration and if this duration is less than or equal to the duration d1+d2, the circuit 42 allows the circuit 43 to generate a calibrated pulse intended for outside monitoring 44.

Thus, in case of a fault in one of the electronic components that leads to a power failure or to a breakdown of the control circuit or to the presence of an arc lasting too long, the calibrated pulse of good health is not generated, which creates an alarm in the monitoring system.

The hybridization system 5 thus gives the contactor properties of a high-voltage contactor.

Advantageously, the material of the contacts of the electromechanical contactor is preserved by limiting the duration of the electric arcs, which allows a high number of opening/closing cycles to be obtained.

The electromagnetic disturbances generated by the electric arcs are advantageously reduced.

The size and the weight of the hybrid contactor is reduced with respect to the related art and without the need to use an auxiliary power source.

Finally, the contactor is advantageously not sensitive to the indirect effects of lightning and electromagnetic compatibility.

The hybridization system 5 can also be used with a fuse or a circuit breaker.

Thus, in FIG. 7, the hybridization system 5 is connected to the terminals A and B of a low-voltage fuse 20.

Like in the case of the contactor, an electric arc is created after the time called pre-arc time. During the arc duration d1, the electric power supply module stores energy via the counter-electromotive voltage of the electric arc. The fuse 20 is then short-circuited during the duration d2 in such a way as to eliminate the electric arc. The electric arc is thus automatically extinguished since an electric current no longer passes through it.

The durations d1 and d2 are advantageously determined in order to regulate the melting time of the fuse.

Thus, the electric arc is eliminated well before the total melting of the fusible material nominally used for a low voltage.

This structure thus allows the range of use of the fuse to be broadened for high voltage by adjusting the melting time of the fuse.

FIGS. 8A to 8D show the presence or absence of an electric arc at the low-voltage fuse 20.

Figure 8A:
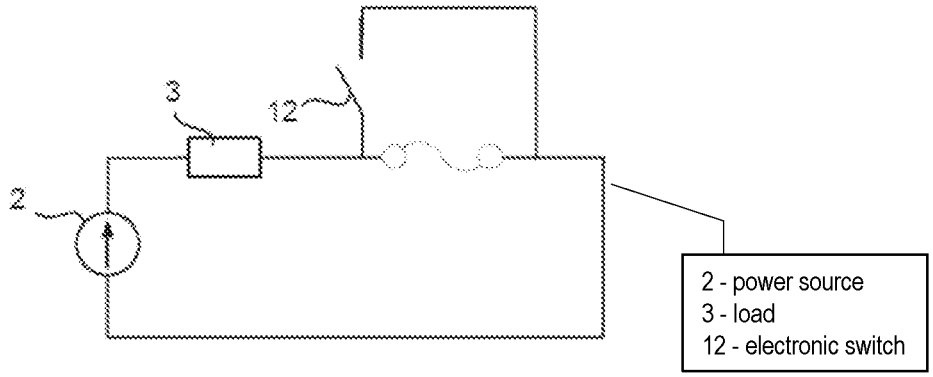
FIG. 8 shows the various phases of operation of the fuse of FIG. 7.

Before the time t0, FIG. 8A, the fuse 20 is in the closed state. It is therefore conductive.

At the time t0, the fuse melts because of a short-circuit or an overload in the electric circuit.

Figure 8B:
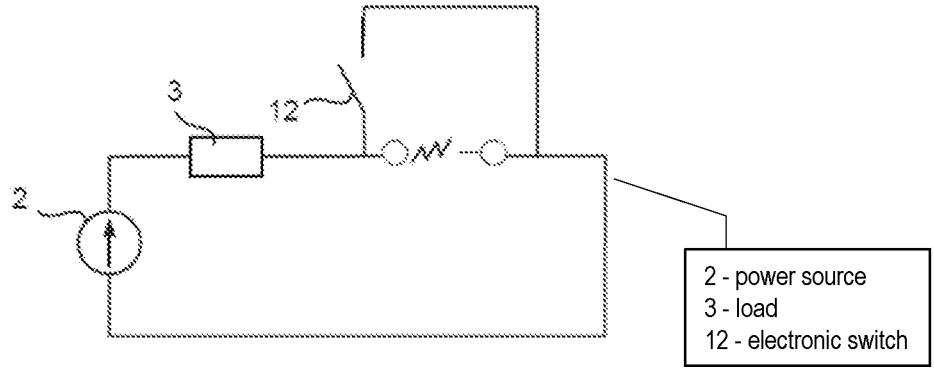

An electric arc thus appears between the terminals of the fuse, FIG. 8B.

Figure 8C:
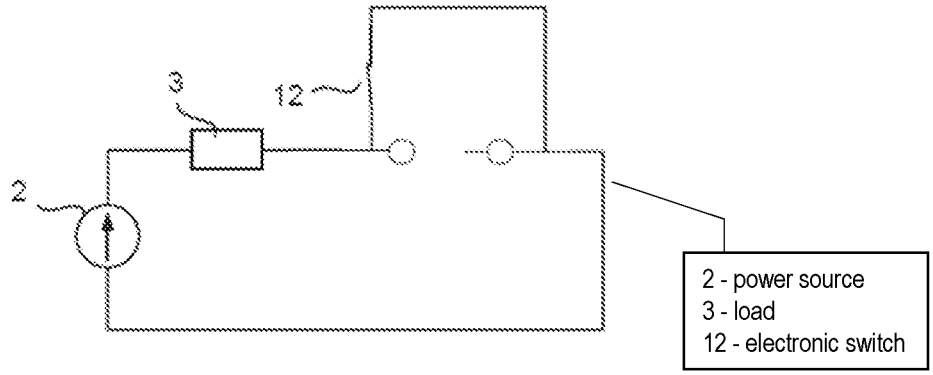
Figure 8D:
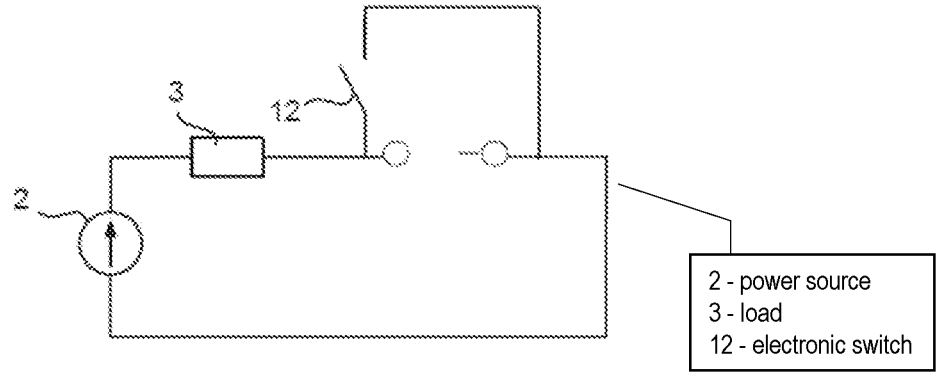

After a duration d1 between 1 μs and 1 ms, the electronic switch 12 switches into the closed state. The fuse is then short-circuited by the electronic switch 12. The electric arc present at the terminals of the fuse is thus extinguished as illustrated in FIG. 8C.

The electronic switch 12 is maintained in the closed state for a duration d2 between 1 μs and 10 ms. Then, after this duration d2, the electronic switch reverts into the open state, FIG. 8D.

The use of the hybridization system with a low-voltage fuse thus gives the fuse properties of a high-voltage fuse while reducing the size with respect to an equivalent conventional high-voltage fuse. It also advantageously allows the melting time of the fuse to be reduced.

In reference to FIG. 9, the hybridization system 5 is used with a low-voltage electromechanical circuit breaker 30.

Thus, an electric arc is created during the opening of the circuit breaker. The phases of appearance and disappearance of the electric arc are the same as those described above for the fuse.

This assembly advantageously allows to confer, to the circuit breaker, properties of a high-voltage circuit breaker while reducing the size of such a high-voltage circuit breaker.

In all of these various embodiments, the electronic switch 12 can include or consist of various elements, FIG. 10.

Figure 10A:
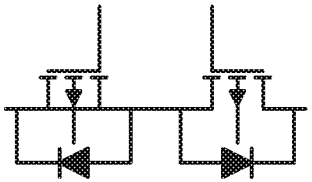
FIG. 10 shows various embodiments of the electronic switch.

Thus, FIG. 10A shows a switch including or consisting of two MOSFET transistors in series, the intrinsic body diode of which ensures the bidirectionality of the current.

Figure 10B:
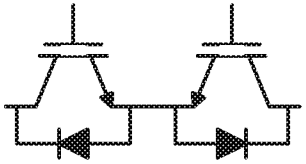

FIG. 10B shows a switch including or consisting of two insulated-gate bipolar transistors (IGBT) in series with an antiparallel diode in order to ensure the bidirectionality of the current.

Figure 10C:
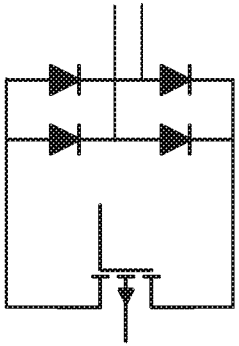
Figure 10D:
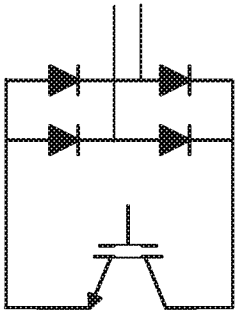

FIG. 10C shows a switch including or consisting of a MOSFET transistor with a diode bridge that ensures the bidirectionality of the current and FIG. 10D shows an insulated-gate bipolar transistor (IGBT) with a diode bridge ensuring the bidirectionality of the current.

Some embodiments have been illustrated and described in detail in the drawings and the preceding description. The latter must or should be considered to be for informational purposes and given as an example and not as limiting some embodiments to this description alone. Numerous alternative embodiments are possible.

The invention claimed is:

1. A hybrid device, comprising:

a hybrid contactor suitable for operating under high-voltage direct current, including:

an electromechanical contactor module connected between a first terminal and a second terminal, the electromechanical contactor module including at least two fixed contacts and at least two movable contacts, each of the two movable contacts being suitable for coming into contact with a specific fixed contact, of the at least two fixed contacts, between the first terminal and an intermediate terminal distinct from the first and second terminal, the electromechanical contactor module being suitable for selectively being in a closed state or an open state;

the electromechanical contactor module having a movable blade with insulation compatible with a high voltage, the electromechanical contactor module being connected between the first terminal and the second terminal, the second terminal being connected to the ground, the electromechanical contactor module including the two fixed contacts and the two movable contacts mounted on the movable blade made of a conductive material, the movable contacts being permanently connected to each other via the movable blade, the electromechanical contactor module having two states:

a closed state in which the movable contacts of the movable blade are in contact with the fixed contacts, in such a way as to electrically connect the two fixed contacts to each other; and an open state in which the movable contacts of the movable blade are at a distance from the fixed contacts;

a hybridization system connected between the second terminal and the intermediate terminal, the hybrid device being suitable for electric arcs to be generated during the switching from the closed state to the open state, the hybridization system including:

two conductors suitable for being connected to the first terminal and to the second terminal of the electromechanical contactor module; the hybrid contactor allowing the presence of the electric arcs at the level between the first terminal and the second terminal of the electromechanical contactor module to be authorized for a limited duration in order to preserve a function of cleaning the first terminal and the second terminal without deteriorating the latter;

a timer switch having two timer switch terminals connected to the two conductors and the timer switch being suitable for being in the open state by default and, after a first predetermined duration following the triggering of the electric arc, switching to the closed state for a second predetermined duration, so that the electric arcs are authorized in the electromechanical contactor module for the first predetermined duration and then cut off, one after the other, during the second predetermined duration; and an electric power supply associated with the timer switch, the electric power supply being connected to the two conductors and being suitable to derive its power only from electric energy provided by the electric arc, the electric power supply including a rectifier module connected at an input to the two conductors and having an output connected to a ballast, the ballast connected via a diode to an energy accumulator, and the energy accumulator having two energy accumulator terminals connected to the timer switch;

wherein the timer switch is controlled by a control circuit powered by the electronic power supply, wherein the hybridization system has a first connector connected to the movable blade in order to establish a voltage transfer and a second connector connected to one of the fixed contacts for a connection having galvanic insulation without the addition of an additional contact in series, wherein during the first predetermined duration, the electromechanical contactor module is open and an electric arc is established by a difference in potential existing between the first terminal and the second terminal, providing electric-arc energy being thus used to charge the energy accumulator during the first moments of the first predetermined duration, the control circuit being thus powered and close the timer switch at the end of the first predetermined duration and for the second predetermined duration, and the hybrid device further including:

a direct high-voltage electric power source, the high-voltage direct current being a direct electric current having a voltage greater than 100V; and a load, and wherein the hybrid contactor is mounted in series with the direct high-voltage electric power source and the load.

2. The hybrid device according to claim 1, wherein the timer switch includes a semiconductor electronic switch connected to the two timer switch terminals of the timer switch, and a circuit for controlling the semiconductor electronic switch powered by the electric power supply.

3. The hybrid device according to claim 2, wherein the hybridization system further includes a dissipative circuit connected in parallel to the timer switch terminals of the timer switch.

4. The hybrid device according to claim 2, wherein the hybridization system further includes a monitoring circuit powered by the electric power supply and suitable for detecting voltage of the electric-arc energy and an electric-arc voltage duration and for generating a signal of correct operation or of anomaly intended for outside monitoring.

5. The hybrid device according to claim 1, wherein the hybridization system further includes a dissipative circuit connected in parallel to the timer switch terminals of the timer switch.

6. The hybrid device according to claim 5, wherein the hybridization system further includes a monitoring circuit powered by the electric power supply and suitable for detecting voltage of the electric-arc energy and an electric-arc voltage duration and for generating a signal of correct operation or of anomaly intended for outside monitoring.

7. The hybrid device according to claim 1, wherein the hybridization system further includes a monitoring circuit powered by the electric power supply and suitable for detecting voltage of the electric-arc energy and an electric-arc voltage duration and for generating a signal of correct operation or of anomaly intended for outside monitoring.

* * * * *